US011776435B2

(12) United States Patent
Vandermyde et al.

(10) Patent No.: US 11,776,435 B2
(45) Date of Patent: Oct. 3, 2023

(54) LAYERED METAL DISPLAY

(71) Applicant: Vandy, LLC, Washington, UT (US)

(72) Inventors: Jonathan Vandermyde, Washington, UT (US); Zachary Vandermyde, St. George, UT (US); Ashton Vandermyde, St. George, UT (US); Christopher Burke, Sherwood, OR (US)

(73) Assignee: Vandy, LLC, Washington, UT (US)

( * ) Notice: Subject to any disclaimer, the term of this patent is extended or adjusted under 35 U.S.C. 154(b) by 0 days.

(21) Appl. No.: 17/730,466

(22) Filed: Apr. 27, 2022

(65) Prior Publication Data

US 2022/0351647 A1 Nov. 3, 2022

Related U.S. Application Data

(60) Provisional application No. 63/183,356, filed on May 3, 2021.

(51) Int. Cl.
*G09F 7/16* (2006.01)

(52) U.S. Cl.
CPC ..... *G09F 7/16* (2013.01)

(58) Field of Classification Search
CPC ..... G09F 7/16; G09F 7/02; G09F 7/06; G09F 7/08; G09F 7/18; A63H 33/088
USPC ..... 40/615, 618, 622; 273/373, 403, 404, 273/407–409, 157 A; 446/108
See application file for complete search history.

(56) References Cited

U.S. PATENT DOCUMENTS 1,928,211 A * 9/1933 Daniel ..... G09F 7/16 40/622

OTHER PUBLICATIONS

Screenshots from the Facebook video clip entitled "A Closer Look At The Hex Head Process", 4 pages, uploaded on Apr. 17, 2020 by user "Hex Head Art". Retrieved from internet: <https://www.facebook.com/hexheadart/videos/a-closer-look-at-the-hex-head-process/999737220428368/>. (Year: 2020).*

* cited by examiner

*Primary Examiner* — Gary C Hoge
(74) *Attorney, Agent, or Firm* — Gurr Brande & Spendlove, PLLC; Robert A. Gurr

(57) ABSTRACT

A layered metal display has a base layer, an item layer, and one or more design layers. The item layer is coupled to the base layer via a plurality of tabs. The tabs extend rearwardly substantially perpendicular to the item layer and pass through tab receiving slots in the base layer. The distal ends of the tabs may be bent, welded, or otherwise secured to the base layer. The two or more layers form a display.

1 Claim, 4 Drawing Sheets

LAYERED METAL DISPLAY

CROSS-REFERENCE TO RELATED APPLICATIONS

This application claims priority to U.S. Provisional Application Ser. No. 63/183,356, filed May 3, 2021, which is incorporated herein by reference.

TECHNICAL FIELD

The present disclosure relates to metal displays. More particularly, the present disclosure relates to a durable alternative for displayed cloth jerseys, other uniforms/clothing, logos, or other items, using layers of metal coupled together to create a cohesive image.

BACKGROUND

Traditionally, the word "jersey" refers to an item of knitted clothing, usually made from polyester, cotton, or other fabrics. Over time, the fabric deteriorates, fades, declines, and wears out. This becomes an issue for jerseys that are on display for many years. As a result, there is a need for a method and apparatus that preserves the look of the jersey (or other desired object). Accordingly, the present disclosure seeks to solve this and other problems.

SUMMARY OF EXAMPLE EMBODIMENTS

In some embodiments, layers of metal sheets are coupled together to form a replica of a team jersey or other object. In some embodiments, a number, name, and/or logo is a separate layered piece that is coupled to a base layer. In some embodiments, the number, name, and/or logo is cut out of the base layer, with additional layers placed behind. In some embodiments, a plurality of tabs each mate with a respective opening/slot to form the assembled jersey.

DETAILED DESCRIPTION OF EXAMPLE EMBODIMENTS

Figure 1:
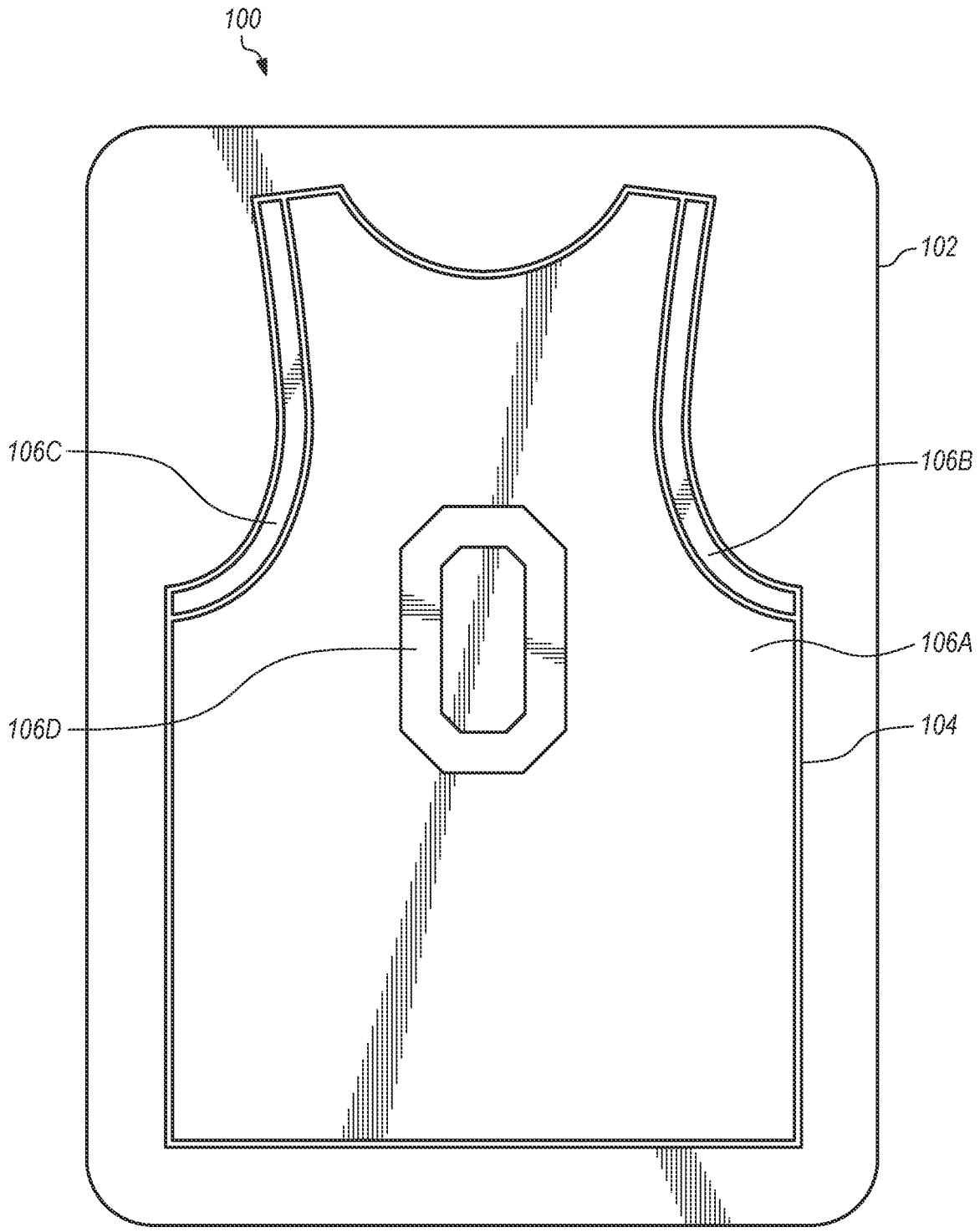
FIG. 1 illustrates a front elevation view of a layered metal display.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a display of a jersey, or other memorabilia or items, that will not deteriorate over time and that has perceived depth. The layered metal display disclosed herein solves these problems and others. It will be appreciated that while a jersey is used as an example throughout this disclosure, the present invention is not so limited and may be used for other displays, including other clothes items or non-clothes items.

Figure 2:
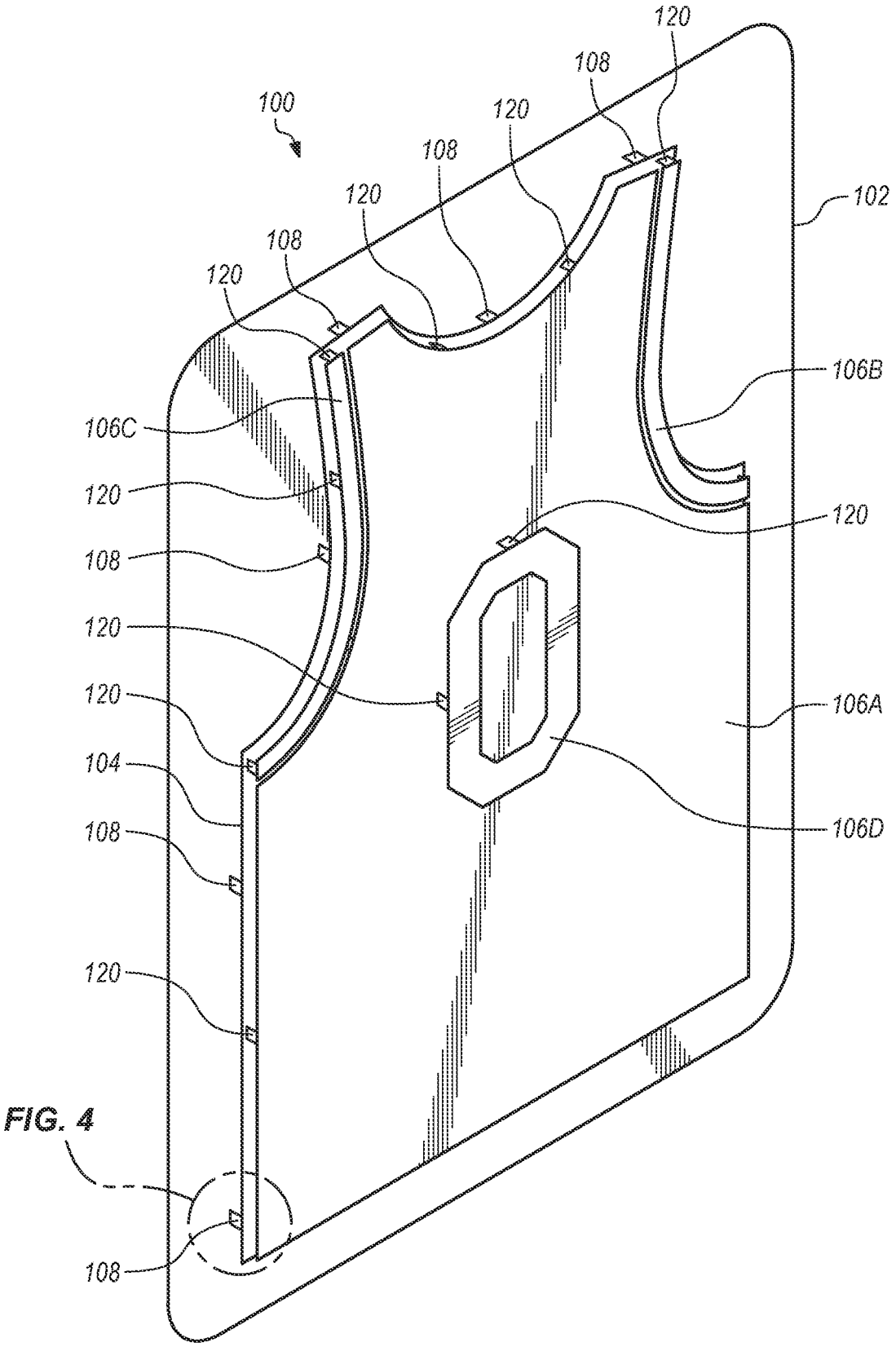
FIG. 2 illustrates a left side perspective view of a layered metal display.
Figure 3:
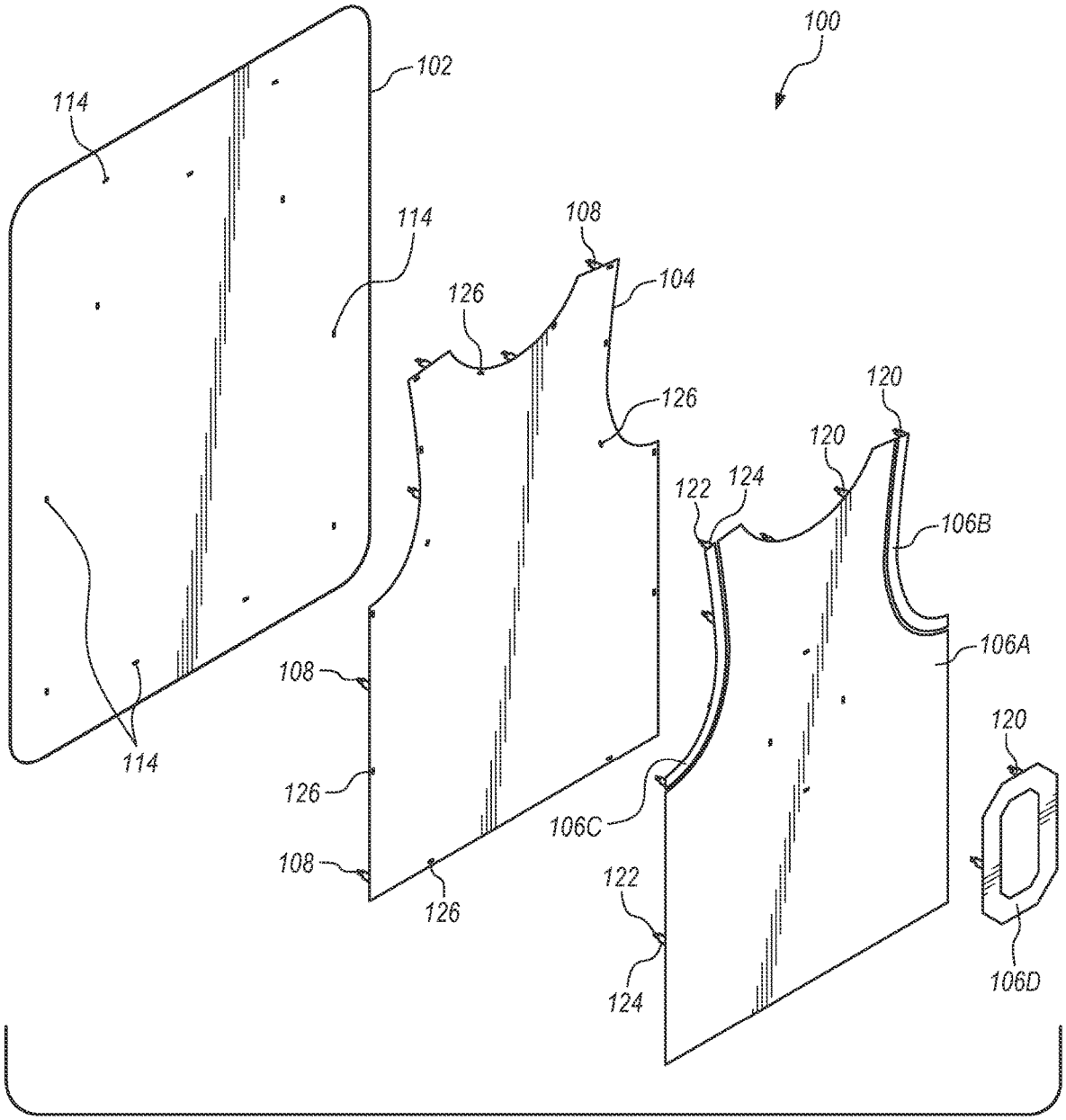
FIG. 3 illustrates a left side exploded view of a layered metal display.

Referring now to FIGS. 1-3, a layered metal display 100 is shown. In some embodiments, the layered metal display 100 comprises a base layer 102, an item layer 104, and one or more design layers 106A-D. The item layer 104 is coupled to the base layer 102 via a plurality of tabs 108. The tabs 108 extend rearwardly substantially perpendicular to the item layer 104. As best seen in FIGS. 4A-E, each tab 108 comprises a first, narrow portion 110 and a second, wide portion 112 that is wider than the first, narrow portion 110. The first, narrow portion 110 of each tab 108 is configured to mate with a respective tab receiving slot 114. For a layer of cut sheet metal, the tab 108 may be bent, as shown from FIGS. 4A to 4B, so that the tab 108 is substantially perpendicular to both the item layer 104 and the base layer 102.

Figure 4A:
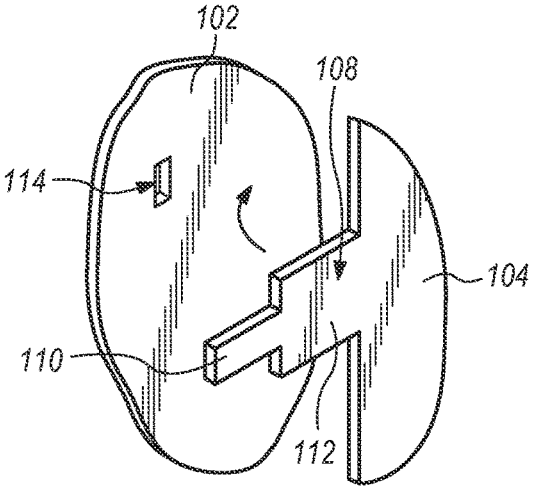
FIG. 4A illustrates a detailed, front perspective view of a tab in a disassembled configuration.
Figure 4B:
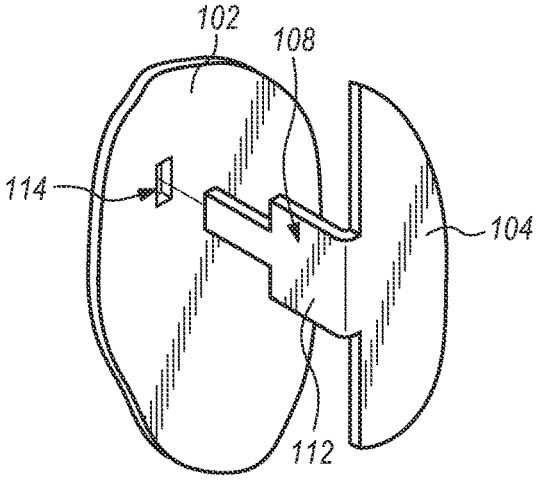
FIG. 4B illustrates a detailed, front perspective view of a tab in a disassembled configuration.
Figure 4C:
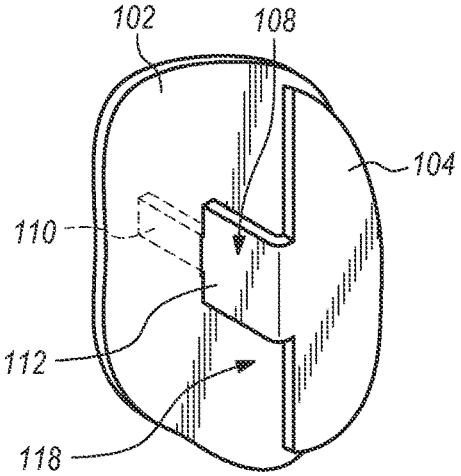
FIG. 4C illustrates a detailed, front perspective view of a tab in a partially assembled configuration.
Figure 4D:
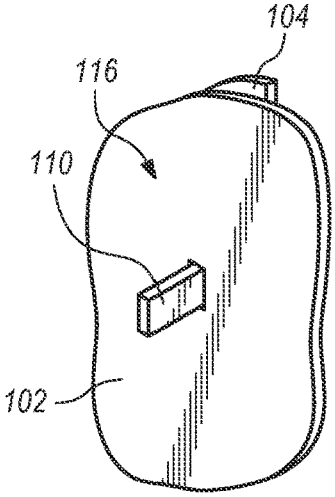
FIG. 4D illustrates a detailed, rear perspective view of a tab in a partially assembled configuration.
Figure 4E:
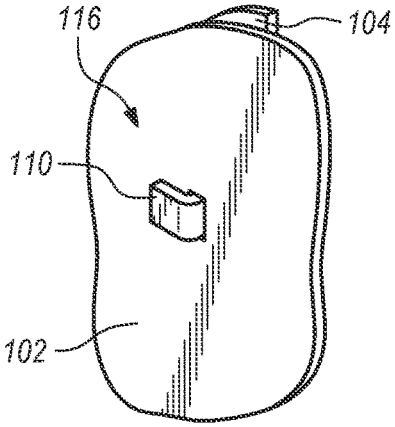
FIG. 4E illustrates a detailed, rear perspective view of a tab in an assembled configuration.

As shown in FIGS. 4C-E, the first, narrow portion 110 is of sufficient length so as to extend through the base layer 102 to a rear side 116. The first, narrow portion 110 may then be bent, as shown in FIG. 4E, so as to prohibit withdrawal of the tab 108 from the tab receiving slot 114. The second, wide portion 112 is wider than the tab receiving slot 114, prohibiting its entry. The second, wide portion 112 is then interposed between the base layer 102 and the item layer 104, creating a gap 118 (equal to the length of the wide portion 112) such that the base layer 102 and the item layer 104 are not in contact with one another. The spacing creates depth to the display, enhancing the aesthetics. While the first, narrow portion 110 may simply be bent, it will be appreciated that other coupling means may be used, such as welding or bending and welding.

Like the item layer 104, each design layer 106A-D comprises tabs 120. Each tab 120 comprises a first, narrow portion 122 and a second, wide portion 124, with the first, narrow portion 122 configured to pass through a respective tab receiving slot 126 on the item layer 104. The first, narrow portion 122 may then be received through a respective tab receiving slot 126 and then be bent so as to remain secured therein in the same process described for FIGS. 4A-E. The second, wide portion 124 of each tab 120 is then interposed between the item layer 104 and each respective design layer 106A-E, forming a gap. The gap creates depth, enhancing the aesthetics. Generally, the base layer 102 is of a first size, the item layer 104 is of a second size smaller than the first size, and the one or more design layers 106A-D have a third size smaller than the second size. Each layer 102, 104, 106 may also have a unique shape and color.

It will be appreciated that the present disclosure is not limited to three layers (e.g., base, item, design). Indeed, the layered metal display 100 may comprise as few as two layers, but may also have more than three, depending on the desired display. Each layer 102, 104, 106 may comprise differing colors as well, allowing for a more vivid display.

One method of assembling the layered metal display 100 comprises coupling a design layer 106A-D to the item layer 104 by inserting the first, narrow portion 122 of the tabs 120 into the respective tab receiving slots 126 of the item layer 104. Once the first, narrow portion 122 of each tab 120 is exposed on the back side of the item layer 104, a user may then bend (and/or weld) the first, narrow portion 122 such that the first, narrow portion 122 cannot be withdrawn back through the tab receiving slot 126, securing the design layer 106A-E to the item layer 104 with a gap therebetween formed by the second, wide portion 124. Once the desired design layers 106A-D are coupled and secured to the item layer 104, a user may then pass the first, narrow portion 110 of tabs 108 through the tab receiving slots 114 of the base layer 102. A user may then bend (and/or weld) the first, narrow portion 110 of tabs 108 such that they cannot be withdrawn through the tab receiving slots 114. The display is then complete and ready for display.

It will be appreciated that each layer (e.g., base, item, design, etc.) may be uniquely cut and colored, so as to create the desired display for a user. For example, the various layers may be cut to shape a sports jersey, helmet, trophy, logo, or any other item a user wishes to display.

In some embodiments, the number, name, logo, and/or shape is cut out of the base layer, with additional layers placed behind and coupled to the base layer.

It will be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A layered metal display configured as a sports jersey, comprising:

a base layer having a first size, the base layer comprising a plurality of first tab receiving slots;

an item layer having a sports jersey formfactor, the item layer having a second size that is smaller than the first size, the item layer comprising:

a plurality of item tabs configured to mate with the first tab receiving slots of the base layer, and a plurality of second tab receiving slots; and a first design layer comprising a sports jersey formfactor, the first design layer having a third size that is smaller than the second size, the first design layer comprising:

a plurality of first design tabs configured to mate, respectively, with the plurality of second tab receiving slots of the item layer, and a plurality of third tab receiving slots;

a plurality of second design layers having a formfactor complementary to at least a portion of the first design layer, the plurality of second design layers each comprising a plurality of second design tabs configured to mate with the plurality of second tab receiving slots of the item layer, respectively, the first design layer and the plurality of second design layers configured to have the same distance from the item layer; and a third design layer comprising a number formfactor, the third design layer comprising a plurality of third design tabs configured to mate, respectively, with the third tab receiving slots of the first design layer;

wherein the plurality of item tabs of the item layer and the plurality of first, second, and third design tabs of each respective design layer each comprise a first, narrow portion and a second, wide portion, wherein each first, narrow portion is configured to pass through the respective tab receiving slot and is configured to bend to prevent withdrawal through the respective tab receiving slot; and wherein each second, wide portion is wider than each respective tab receiving slot and is positioned, respectively, substantially perpendicular to the base layer, item layer, and the plurality of design layers, forming a gap between the item layer and base layer, between the first and second design layers and the item layer, and between the third design layer and the first design layer.

* * * * *